US006283268B1

(12) United States Patent
Fletcher et al.

(10) Patent No.: US 6,283,268 B1
(45) Date of Patent: Sep. 4, 2001

(54) BEZEL FOR AN AUTOMATIC TRANSACTION MACHINE

(75) Inventors: Paul R. Fletcher, Camberley Surrey (GB); Frank Mars, McLean, VA (US)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/194,504

(22) PCT Filed: May 27, 1997

(86) PCT No.: PCT/US97/09191

§ 371 Date: Apr. 8, 1999

§ 102(e) Date: Apr. 8, 1999

(87) PCT Pub. No.: WO97/45813

PCT Pub. Date: Dec. 4, 1997

Related U.S. Application Data

(63) Continuation-in-part of application No. 08/655,726, filed on May 30, 1996, now Pat. No. 5,791,449.

(51) Int. Cl.[7] ..... G07F 1/02
(52) U.S. Cl. ..... 194/344; 194/350
(58) Field of Search ..... 194/205, 206, 194/207, 208, 210, 344, 348, 350, 351; 235/381

(56) References Cited

U.S. PATENT DOCUMENTS

| | | | | |
|---|---|---|---|---|
| 3,768,616 | | 10/1973 | Dykehouse et al. | 194/206 |
| 3,783,989 | | 1/1974 | Jense | 194/206 |
| 3,788,333 | | 1/1974 | Johnson | 194/206 X |
| 4,504,052 | | 3/1985 | Murck et al. . | |
| 4,598,810 | | 7/1986 | Shore et al. | 235/381 X |
| 4,706,794 | | 11/1987 | Awane et al. . | |
| 4,733,765 | * | 3/1988 | Watanabe | 194/206 |
| 4,850,468 | * | 7/1989 | Kobayashi et al. | 194/207 |
| 4,884,212 | | 11/1989 | Stutsman | 194/205 X |
| 5,290,033 | | 3/1994 | Bittner . | |
| 5,310,035 | | 5/1994 | Dobransky, Jr. et al. . | |
| 5,318,164 | | 6/1994 | Barnes et al. | 194/206 X |
| 5,344,046 | | 9/1994 | Maldanis et al. . | |
| 5,413,245 | | 5/1995 | Wright . | |
| 5,566,809 | | 10/1996 | Vogt et al. | 194/348 |
| 5,635,696 | | 6/1997 | Dabrowski | 194/206 |

* cited by examiner

*Primary Examiner*—F. J. Bartuska
(74) *Attorney, Agent, or Firm*—Fish & Richardson P.C.

(57) ABSTRACT

An automatic transaction machine bezel (150) for attachment to the front panel of the machine (1) that is durable and versatile, and that advantageously provides for at least two forms of payment is disclosed. The face (151) of the bezel fits through an industry-standard size opening in the front panel of the automatic transaction machine. In one embodiment, the bezel contains one aperture to accept banknotes, coins and cards in payment for a vend item.

14 Claims, 11 Drawing Sheets

BEZEL FOR AN AUTOMATIC TRANSACTION MACHINE

This application is a continuation-in-part of Ser. No. 08/655,726, filed May 30, 1996, now U.S. Pat. No. 5,791, 449.

BACKGROUND OF THE INVENTION

The invention relates generally to a bezel having at least one aperture to receive two or more forms of money, wherein the face of the bezel fits through an industry-standard size opening in the front panel of an automatic transaction machine. The opening formerly has been reserved for accommodating a bill validator only. For example, a bezel according to the invention may have one or more apertures to accept banknotes and coins, or banknotes and credit cards, or some other combination. Consequently, a bill validator and a coin validator, or a bill validator and a card reader, or some other combination of money acceptance means connect to the rear of the bezel.

Prior art candy vending machines typically accepted only coins as payment for a vend item. In contrast, modern day vending machines and other automatic transaction systems may contain a coin slot for depositing coins, a bill entryway for inserting paper currency, and a card reader opening for inserting a debit or credit card. The new payment modes have been added to vending machines over time as vending items became more expensive, and as the technology for reliable bill validators and card readers developed.

Customarily, a bezel for each form of payment having an insertion slot or opening has been attached to the front panel of a vending machine. For example, payment acceptance devices for coins, bills, tokens and cards each are connected to a bezel, and the three bezels are located on the right side of the front panel. This area is usually referred to as the control panel. However, as new forms of payment acceptance devices have been retrofit to existing machines, it has become more difficult to attach them to the control panel because the amount of space available is finite, and because of internal component space restrictions. Thus, some vending machines have bezels with money insertion slots located in areas other than the control panel. Consequently, one type of vending machine may differ from another by having bezels connected in different designated areas for payment, by accepting different forms of payment, and further may be marked in an entirely different manner. Since no standard configuration exists for accepting payment, consumers are often confused when it comes to the method and types of acceptable payments to enable a vend. Such non-uniformity may frustrate a customer, resulting in lost profits by the automatic transaction machine owners. Consequently, a need exists for a standard size bezel that can accommodate two or more money acceptance means.

SUMMARY OF THE INVENTION

In one aspect, the invention concerns a bezel for attachment to the front panel of an automatic transaction machine having at least two apertures for accepting different forms of payment. In particular, the face of a bezel fits through an industry-standard size bill entryway opening in the front panel, and has two or more apertures for accepting money. A base plate connected to the face has connection means for attachment to the front panel or frame of a vending machine. A bill validator, a coin validator and/or a card reader may attach to the base plate of the bezel. In addition, the bezel may also contain a coin reject button. Consequently, a bezel according to the invention advantageously permits a consumer to quickly determine exactly what types of payment are acceptable to procure a vend item.

Another embodiment of the invention pertains to a bezel for an automatic transaction machine, such as a gaming machine, vending machine, pay telephone or the like, that has a face with one aperture for accepting at least two forms of payment. In particular, the face of the bezel fits through an industry-standard size opening in a panel of the automatic transaction machine. A bill validator, a coin validator, a card reader or other payment acceptance means may attach to the rear of the bezel, depending on transaction machine requirements. A base plate may be connected to the face for attachment to the front panel.

The bezel permits the utilization of a single liquid diverting tray anti-fraud component because the apertures are clustered in one area, and in the case of the second embodiment there is only one aperture. The liquid diverting tray may be attached to the base plate, and functions to limit the damage that may occur from the introduction of fluids through the aperture or apertures.

In addition, one or more connectors may be attached to the base plate on the rear of the bezel, for guiding the wires from the money acceptance means. Alternately, a universal connector may be used to facilitate the connections of the money acceptance components.

DESCRIPTION OF THE PREFERRED EMBODIMENTS

Figure 1:
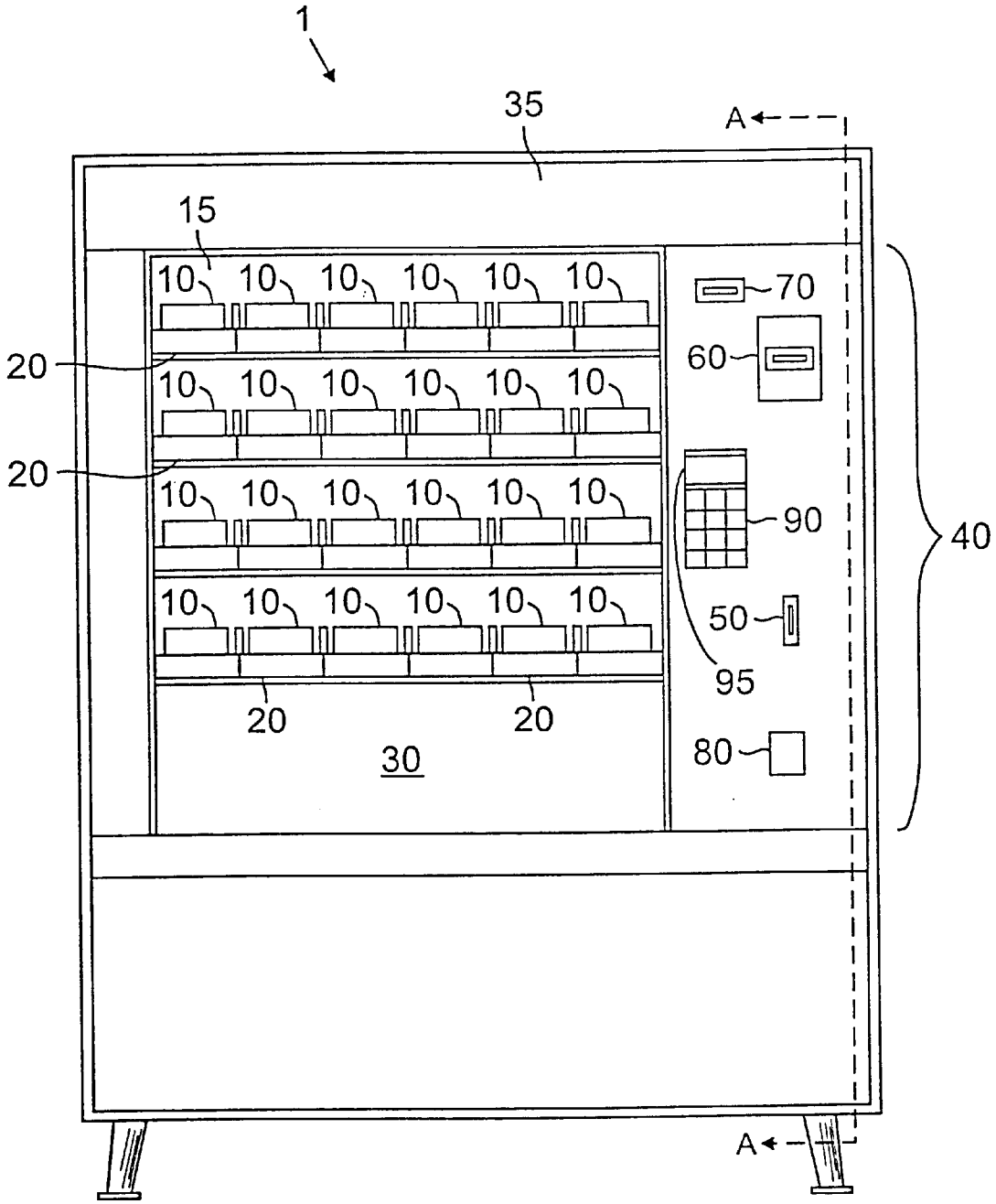
FIG. 1 PRIOR ART
FIG. 1 is a front view of a prior art vending machine system that accepts multiple forms of payment.

FIG. 1 is a front view of a prior art multiple payment vending machine system 1 which is capable of accepting a plurality of payment means in exchange for a product. In particular, the vending machine system 1 can accept coins, passive and smart tokens, banknotes or bills, smart cards, credit or debit cards and electronic purse devices. The term "electronic purse device" used herein denotes a token or card possessing an electronic circuit, a magnetic strip or other data storing medium or circuitry, for retaining a credit value equivalent to money. Although a vending machine system 1 is used as an example, the invention also applies to other automatic transaction systems, such as gaming machines, pay telephones and the like. It should also be understood that like components in the figures have been numbered the same throughout for ease of reference.

Referring to FIG. 1, a variety of products 10 to be dispensed are stored in a display area 15 inaccessible to customers, such as behind a transparent glass panel. Each product 10 is retained by a product delivery apparatus 20 that is selectively actuatable by a customer to dispense the product into a delivery area 30 from which the customer can retrieve the selected product.

The front panel 35 of the vending machine system 1 has a control panel 40 having a coin slot 50, a bill entryway 60 and a card opening 70 to accept payment for an item. The card opening 70 may accept an electronic purse device, credit card or debit card. The control panel 40 also contains a coin return 80 and an item selector such as a keypad 90. A display 95 may provide instructions and information to a customer.

A customer initiates a transaction by depositing coins or bills of particular denominations into respective openings 50 or 60 along the control panel 40 in payment for an item. A customer may also insert an electronic purse device, or a debit or credit card into card opening 70 to initiate a transaction. Once sufficient payment has been deposited, the customer may select a product 10 to be dispensed using keypad 90. The corresponding product delivery apparatus 20 will then dispense the selected product 10 to the product delivery area 30 where it can be retrieved by the customer. Any change resulting from the transaction may be paid back to the customer through the coin return opening 80 or be credited by a card reader to an inserted electronic purse device. Details concerning money validation, card validation, establishing credit, dispensing products, paying out change, and other such vending machine or other automatic transaction machine functions are beyond the scope of this application and thus will not be discussed herein.

Figure 2:
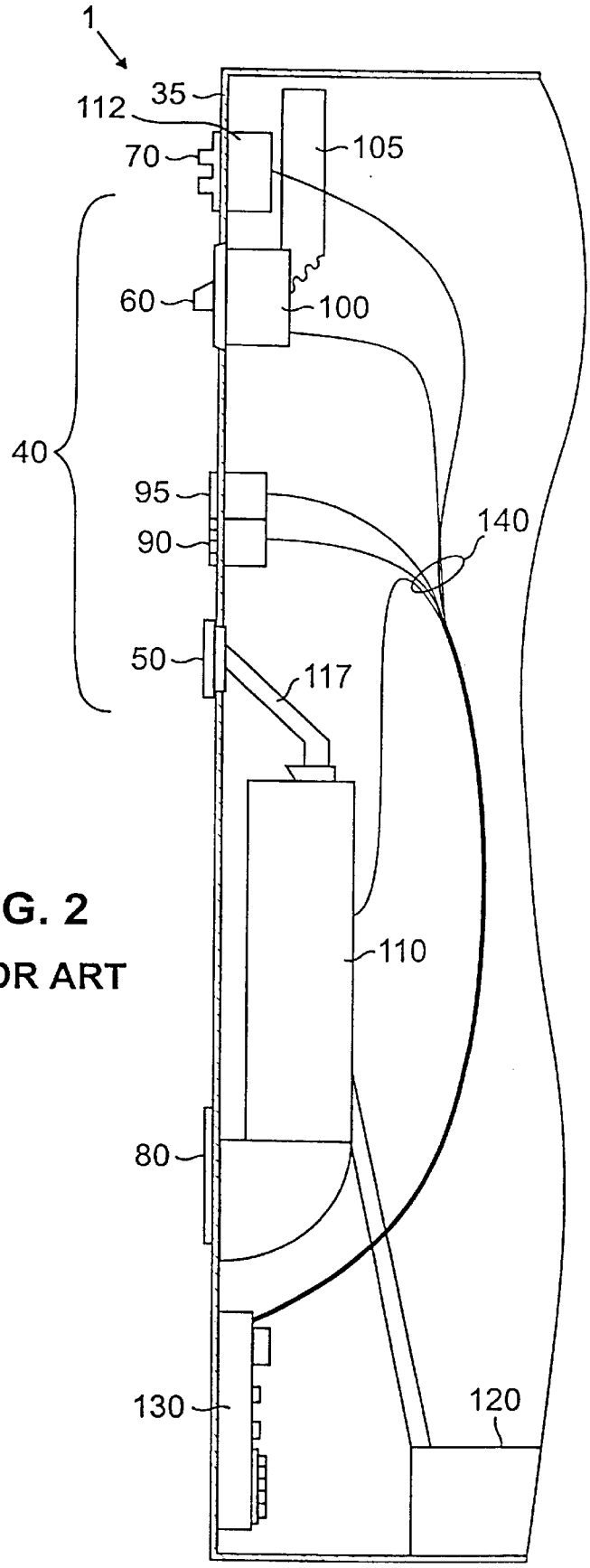
FIG. 2 PRIOR ART
FIG. 2 is an enlarged, cutaway side view of the vending machine system of FIG. 1.

FIG. 2 is an enlarged, cutaway side view along dotted line A—A of FIG. 1 which illustrates the layout of typical internal components of the vending machine. In particular, connected to the rear of the control panel 40 are a bill validator 100 which is aligned with the bill entryway 60, a coin mechanism 110 connected to the coin slot 50 via coin passageway 117, and a card reader 112 aligned with the card opening 70. The coin mechanism 110 is also attached to the coin return 80, and to a coin box 120. The bill validator 100 is also attached to a bill stacker 105. A keypad 90 and display 95 are also connected to the control panel 40, and are electronically connected via lines 140 to a vending controller 130. The card reader 112, bill validator 100 and coin validator 110 are also electronically connected to the vending controller 130. It will be understood by those of skill in the art that the connection of the payment devices shown in FIGS. 1 and 2 to the vending machine front panel 35, and the electronic connections to the vending controller 130 are merely illustrative. Many other configurations may be used. For example, the coin mechanism 110 may contain a microprocessor that supervises the activities of the bill validator 100 and the card reader 90 and that authorizes a vend, such that only total credit information is sent to the vending controller 130. Further, some or all of the money acceptance apertures may be located to the left of the product display area 15 and not in the control panel 40, which affects the placement of the payment acceptance devices within the vending machine 1.

Figure 3B:
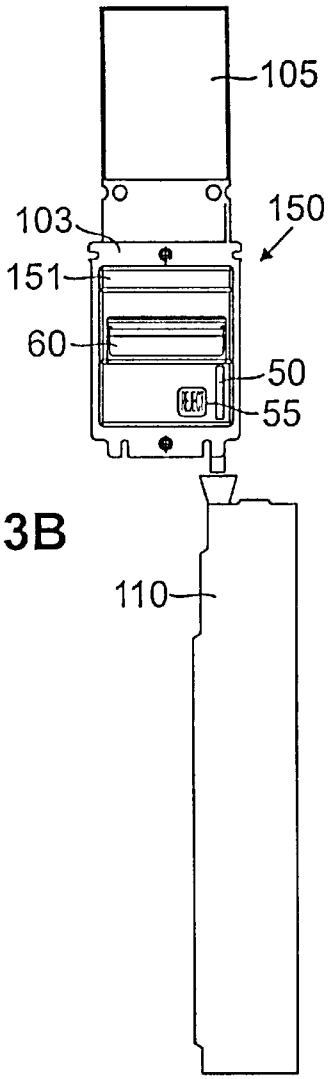
FIG. 3B is a scaled-down front view of the bezel of FIG. 3A shown with a bill stacker and a coin validator.
Figure 3A:
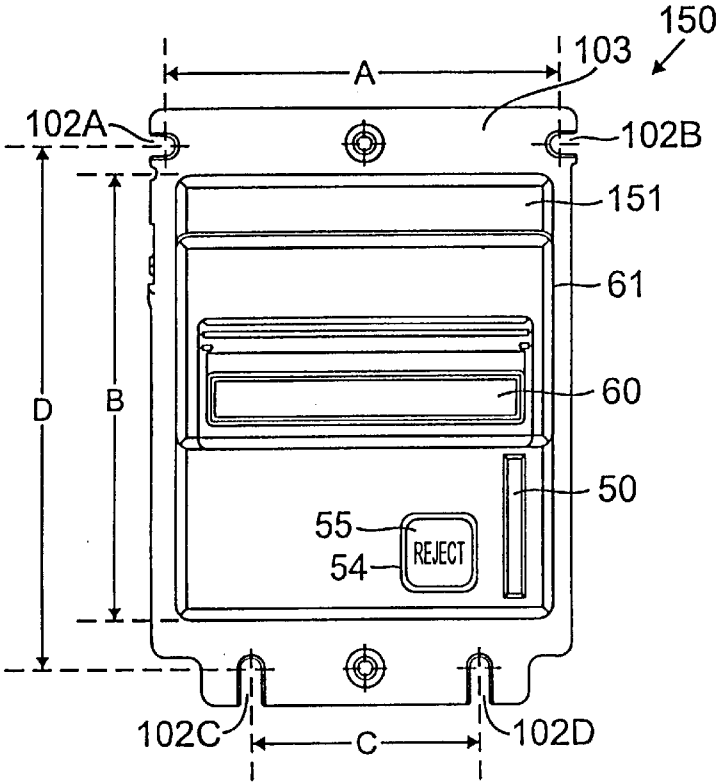
FIG. 3A is a front view of a bezel according to the present invention.

FIG. 3A is a front view of an embodiment of a bezel 150 according to the invention. The bezel 150 is preferably made of steel, aluminum, or other metal, but may also be comprised of a durable plastic, strong composite material or a combination of such materials.

Referring to FIG. 3A, the face 151 of the bezel 150 is designed to fit into an industry-standard size bill entryway opening in a front panel of a vending machine that is typically reserved for connection of a bill validator only. Consequently, the face 151 of the bezel 150 has a width "A" of approximately 86.20 millimeters (3.394 inches), and a length "B" of approximately 108.70 millimeters (4.280 inches). The four cut-out connector portions labelled 102A, 102B, 102C and 102D are arranged about the base plate 103 of the bezel 150 to enable easy attachment to the control panel 40, or to a frame component (not shown) internal to the vending machine. The width "A" between the centers of the cut-out portions 102A and 102B is approximately 86.20 millimeters (3.394 inches), and the width "C" between the centers of cut-out portions 102C and 102D is approximately 50.80 millimeters (2.0 inches). The length "D" between the centers of cut-out portions 102A and 102C is approximately 117.48 millimeters (4.625 inches). These measurements for "A", "C" and "D" match standard mounting stud locations found inside vending machines. Also shown are a coin slot 50, a bill entryway 60 fitted through an opening 61, and a reject button 55 fitted through an opening 54 (see FIG. 6). The coin slot 50 is sized to enable coins from a particular country's coin set to pass therethrough.

One of skill in the art understands that other automatic transaction system industries, such as the gaming industry or payphone industry, have their own standard size panel openings for accommodating bezels and their associated payment acceptance means. These automatic transaction system industries also have their own standard mounting stud locations which may or may not be similar to those set forth above in the vending machine example. A bezel according to the aspects of the invention disclosed herein could be made of such dimensions to conform to any of the panel opening and stud location size standards that are promulgated.

Referring again to FIG. 3A, the reject button 55 need not be included in the face 151 of bezel 150, and could be located elsewhere in the control panel 40. Thus, opening 54 need not be provided in the bezel. However, a coin reject button is conventionally located adjacent to the coin slot for the convenience of the consumer.

FIG. 3B is a scaled-down view of the bezel 150 of FIG. 3A illustrating the internal positions of a bill stacker 105 and a coin validator 110 in relation to the bezel 150. A consumer would only view the bezel face 151 from her vantage point, which defines the transaction area for the vending machine. However, the bezel is also advantageously designed from the perspective of the vending machine owner because it permits the easy replacement of each payment module in the field. Further, the bezel 150 enables all of the apertures leading into the vending machine to be clustered in one area, which can simplify the design of security features as discussed below. In addition, the invention simplifies vending machine manufacture since only one bezel need be mounted on the front panel instead of multiple bezels (one for each payment acceptance means).

Figure 4A:
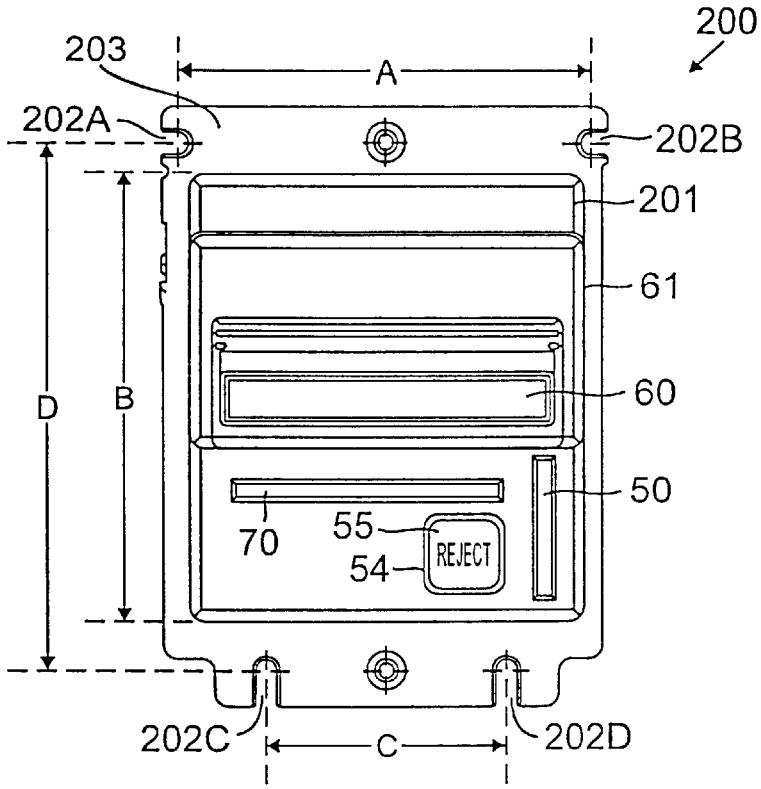
FIG. 4A is a front view of another embodiment of a bezel according to the present invention.

FIG. 4A is a front view of another embodiment of a bezel 200 according to the invention, having three money acceptance apertures, a card opening 70, a bill entryway 60 and a coin slot 50. A coin return button 55 is also shown, which is optional as explained above. The face 201 of the bezel 200 fits into the industry-standard bill entryway opening in a front panel of a vending machine. Consequently, the dimensions "A" and "B" of the face 201 are the same as those described above with respect to FIG. 3A. Similarly, the four cut-out portions 202A, 202D, 202C and 202D are arranged about the base plate 203 to permit easy attachment to the control panel 40 of a vending machine, and the dimensions defined by "A", "C" and "D" are the same as those described above with respect to the bezel 150 of FIG. 3A.

Figure 4B:
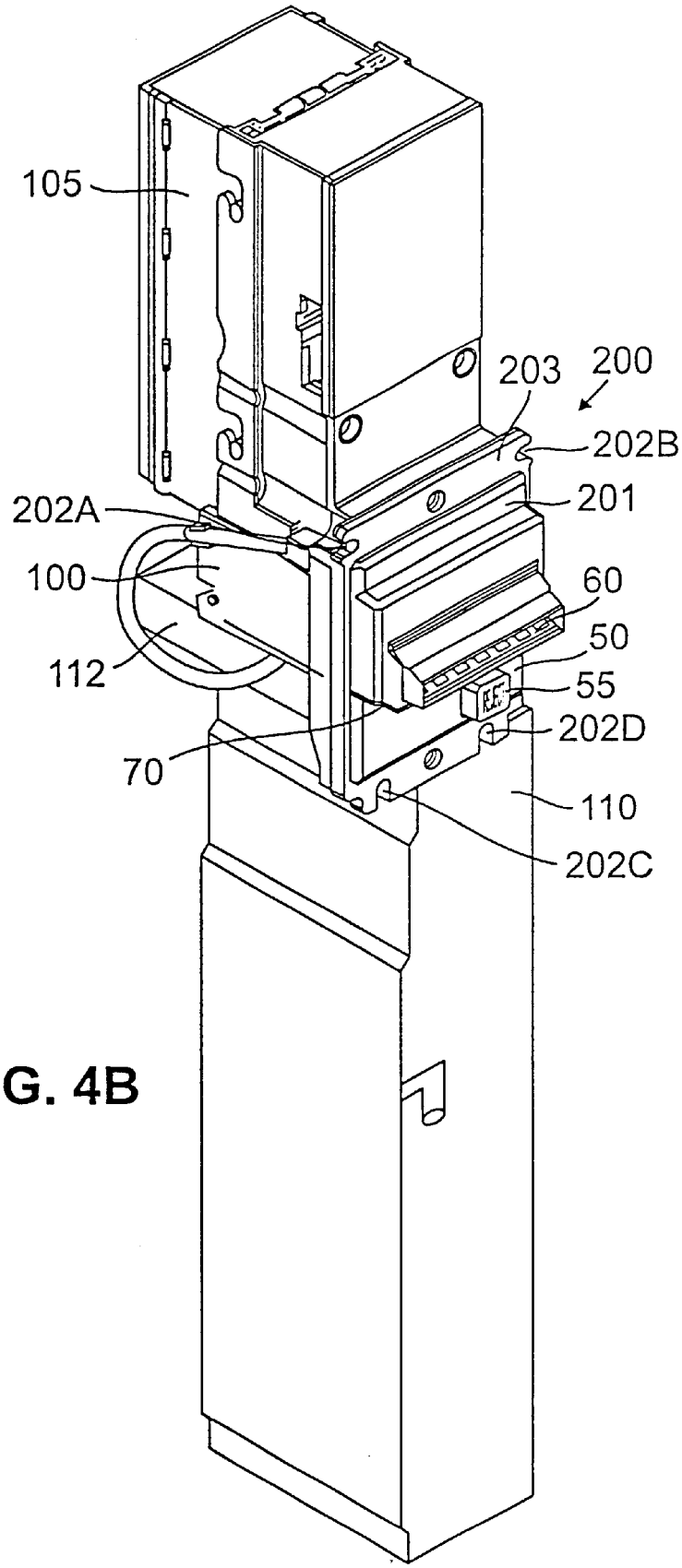
FIG. 4B is a left-side perspective view of the bezel of FIG. 4A shown with attached bill validator, coin validator and card reader.

FIG. 4B is a left-side perspective view of the bezel 200 of FIG. 4A connected to a bill validator 100 and associated bill stacker 105, a coin validator 110 and a card reader 112. As explained above, the face 201 of the bezel 200 is sized to fit through an industry-standard size bill entryway opening in the control panel 40 of a vending machine. However, as explained above, such a bezel could be made to fit other standard size openings, and to connect to other stud locations, of any particular type of automatic transaction machine. Thus, a consumer need only find the face 201 of the bezel 200 to locate the transaction area. In particular, the consumer may insert a bill into bill entryway 60, or coins into coin slot 50 or a card into card opening 70 to pay for a transaction.

Referring again to FIG. 4B, the bill entryway 60 and coin return button 55 project outwardly from the face 201 of the bezel 200. The coin slot 50 and the card opening 70 are flush with the face 201 of the bezel 200. One of skill in the art, however, could easily arrange for one or more of the other openings to project from the face of the bezel. Alternately, the bezel could be manufactured such that all or some of the openings, and the coin return button 55, are flush with the face.

Figure 4C:
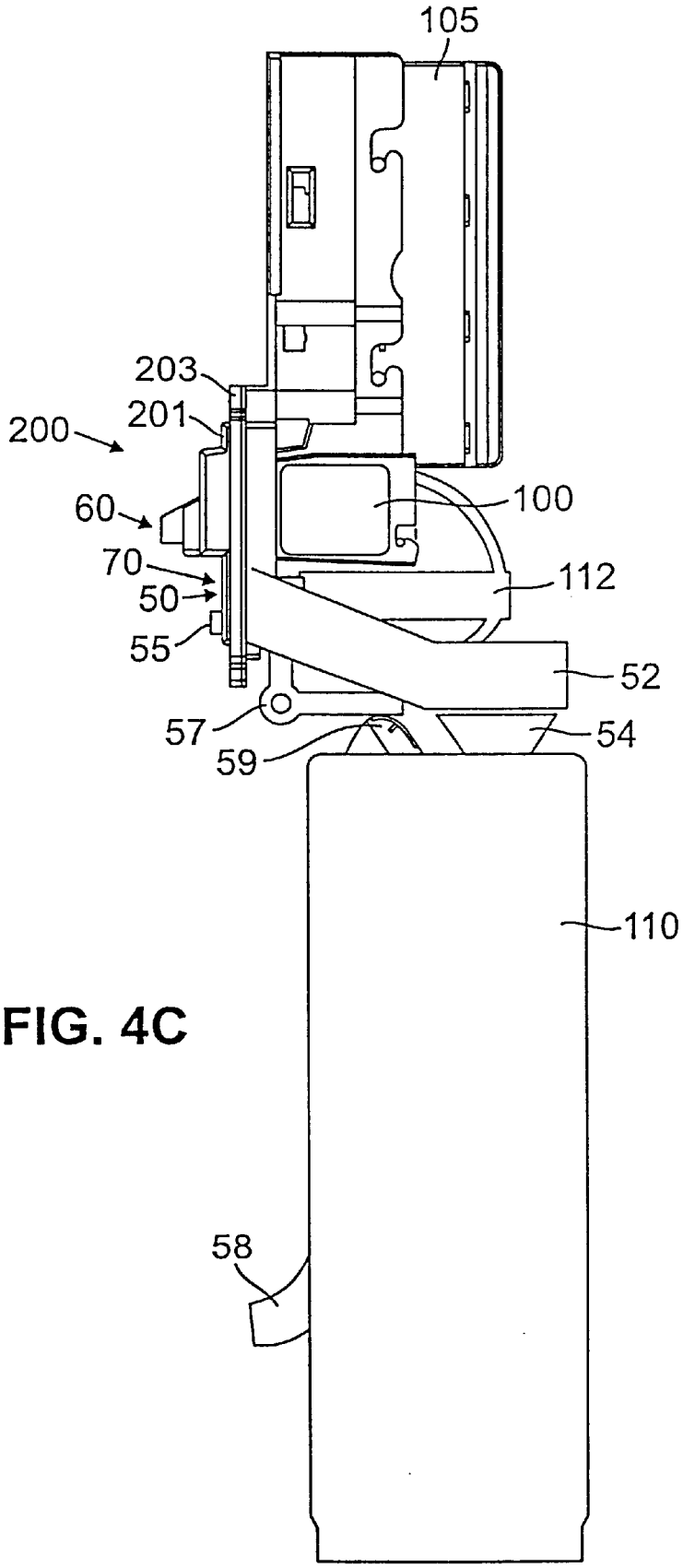
FIG. 4C is a right side view of the bezel and attached components of FIG. 4B.

FIG. 4C is a right side view of the bezel 200 and components FIGS. 4A and 4B. It can be easily seen from FIG. 4C that the bill entryway 60 and coin return button 55 project from the face 201 of the bezel 200, while the card opening 70 and coin slot 50 are flush therewith. Also shown in FIG. 4C, aligned with their respective openings in the bezel 200, are a bill validator 100 and associated bill stacker 105, a card reader 112 and a coin validator 110. Regarding the coin validator 110, a coin passageway 52 is aligned with the coin slot 50 to guide an inserted coin to a coin receiving cup 54. In addition, a linkage 57 connects the coin return button 55 to the return switch 59 of the coin validator 110, so that a coin will be returned after its insertion via return chute 58 when the coin return button 55 is pressed by a consumer. Alternatively, the coin return button 55 could be connected to the coin mechanism 110 via a remote switch and an electronic actuator to provide for the return of inserted coins.

A bezel according to the present invention provides a minimal number of apertures into the machine that are clustered in one spot. A fraud technique practiced by vandals involves injecting liquids through one or more of the apertures in an attempt to cause the machine to pay out change or to vend items. Thus, FIG. 5A illustrates the bezel 200 of FIGS. 4A–4C with an attached fluid diverting tray 300 fitted beneath the payment openings 50, 60 and 70. The fluid diverting tray 300 has connection means for attachment to the rear of the base plate 203 at cut out portions 202C and 202D. The tray 300 contains a drain 302, and functions to protect the coin mechanism 110 and other interior vending machine components from a fluid attack.

Figure 5B:
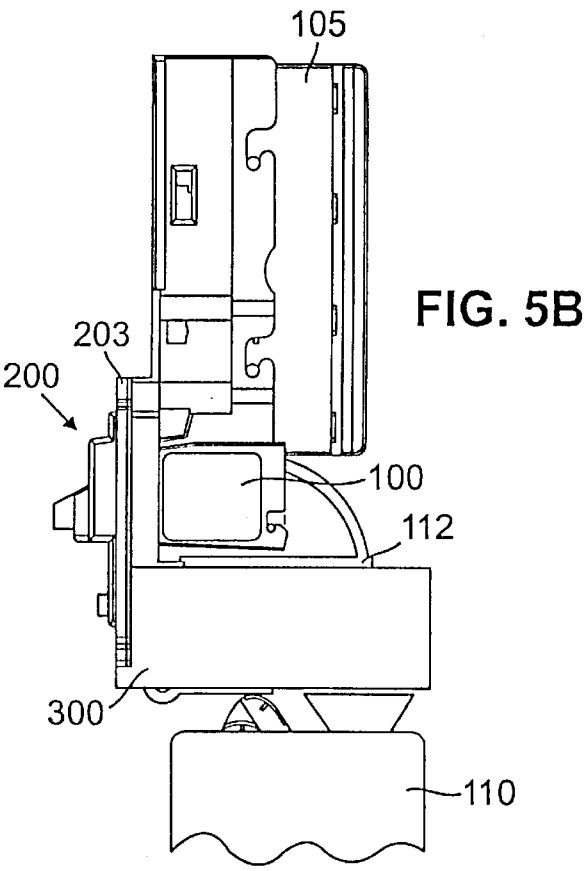
FIG. 5B is a side view of FIG. 5A.
Figure 5A:
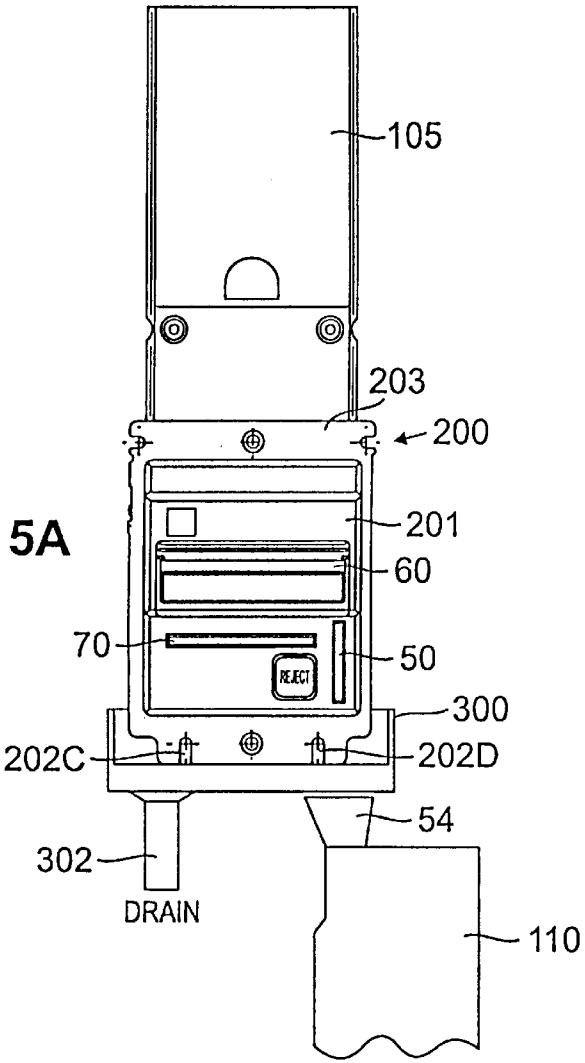
FIG. 5A is a front view of the bezel of FIG. 4A shown connected to a tray.

FIG. 5B is a side view of the bezel 200 and payment means configuration of FIG. 5A. The fluid diverting tray 300 is shown positioned above the coin validator 110 and protects it by directing any injected fluids to drain 302.

Figure 6:
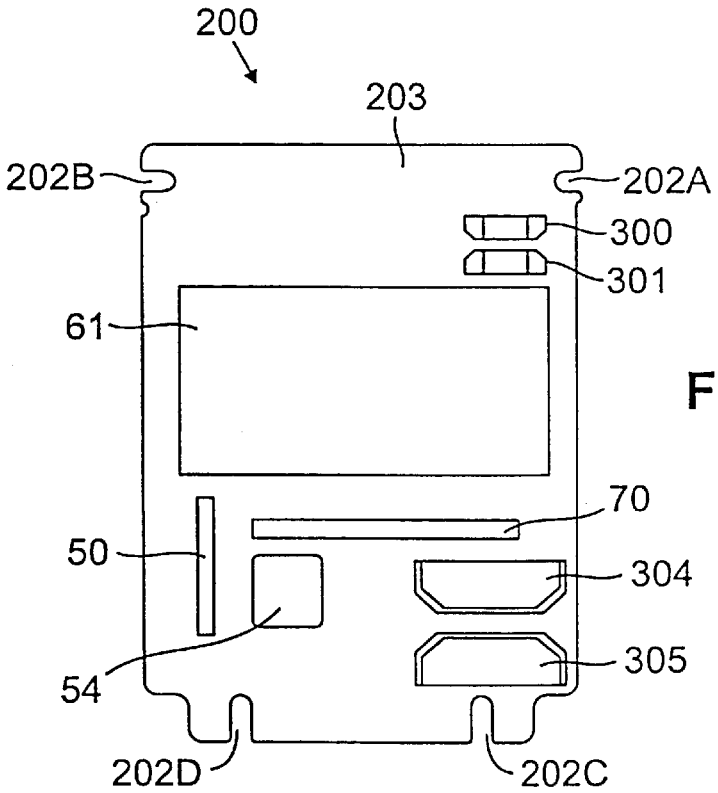
FIG. 6 is a rear view of the bezel of FIG. 4A shown with connectors.

FIG. 6 is a rear view of the bezel 200 of FIG. 4A illustrating the apertures in the base plate 203 in the absence of the money acceptance components. A bill validator opening 61, coin slot 50, coin return button opening 54 and card aperture 70 are shown. In addition, wire guides 300, 301 and 304, 305 are depicted. The wire guides 300, 301 and 304, 305 may be clips which are designed to hold, gather and/or guide the electrical wires from the various money acceptance components to facilitate their electrical connection and disconnection. Other types of wire harnessing devices could be used in alternate configurations depending on the money acceptance components used and their physical and electrical relationship to one another, which would be readily apparent to one of skill in the art. Alternately, a universal connector integrated into the base plate could be used. The payment devices would all plug into the universal connector, which would simplify the electrical connections of the money acceptance means by eliminating all other cables except for one interface cable.

Figure 7A:
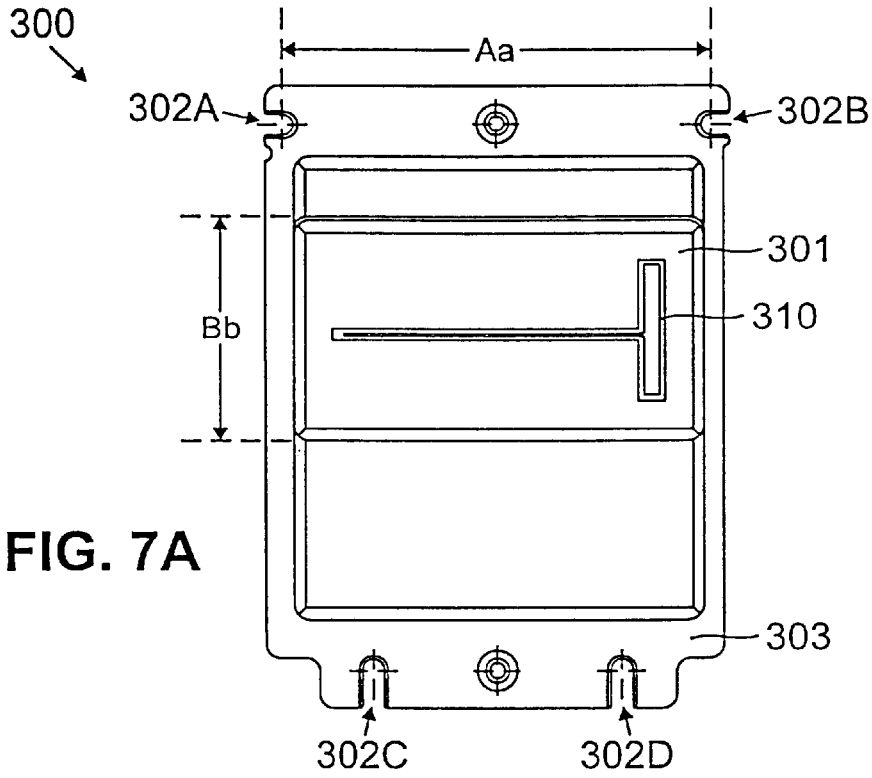
FIGS. 7A–7C are front views of three variations of another embodiment of a bezel according to the invention.

FIG. 7A is a front view of another embodiment of a bezel 300, having one payment acceptance aperture 310 for accepting both bills and coins. A consumer tenders bills in a horizontal orientation and coins in a vertical orientation into the aperture 310. The bill and coin entryways are linked and overlap with each other. The corresponding acceptance means are attached from the interior of the automatic transaction machine, and the coin passageway and bill entryway intersect to the right side of the bezel as shown. The face 301 of the bezel fits into an industry-standard size opening through a panel of the automatic transaction machine, which size is determined by the type of machine and industry for which the bezel 300 is designed. Consequently, the dimensions "Aa" and "Bb" may be different depending on, for example, if the bezel is for use with a gaming machine or for a pay telephone. Similarly, the four cut-out portions 302A, 302B, 302C and 302D are arranged about the base plate 303 to permit easy attachment to the automatic transaction machine of choice, and the base plate and cut-out portions would be dimensioned accordingly.

FIGS. 7B–7C and 8A–8C illustrate alternate embodiments of a bezel having one aperture for accepting two or more forms of payment. Like components have been numbered the same for ease of reference. For example, the face 301 and base plate 303 of FIGS. 7B–7C and 8A–8C have the same dimensions as that of FIG. 7A in these examples. However, as discussed above, the dimensions of the face, base plate, and cut-out portions could be changed to match whatever size is required by a particular type of automatic transaction machine. In addition, the size of the aperture or apertures for accepting coins, bills, card, tokens and/or other payment means will be appropriate for accepting payment types normally accepted in the country or countries where the automatic transaction machine will be in use. For example, the coin and bill openings of a bezel for use in the Mexican market will be a different size than that for use in the Canadian market. Such modifications are well within the capability of one skilled in the art.

Figure 7B:
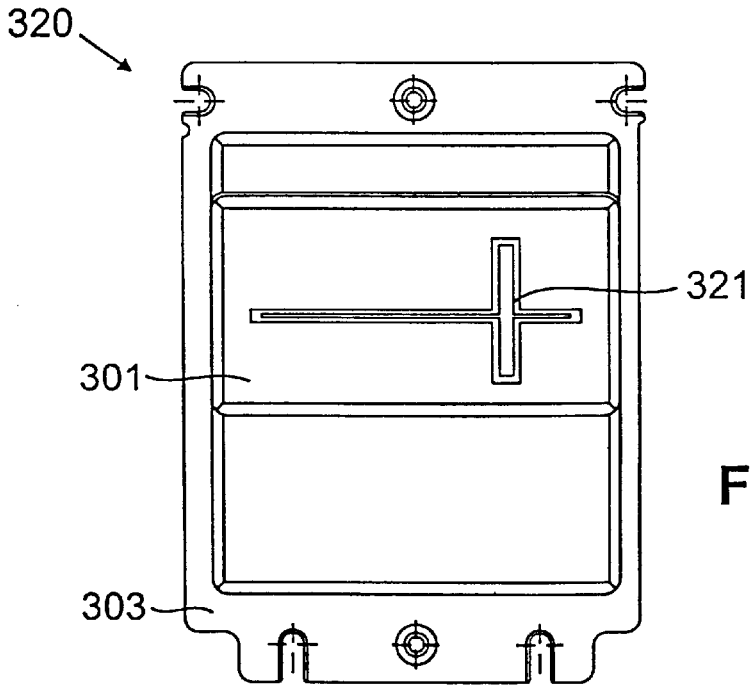
Figure 7C:
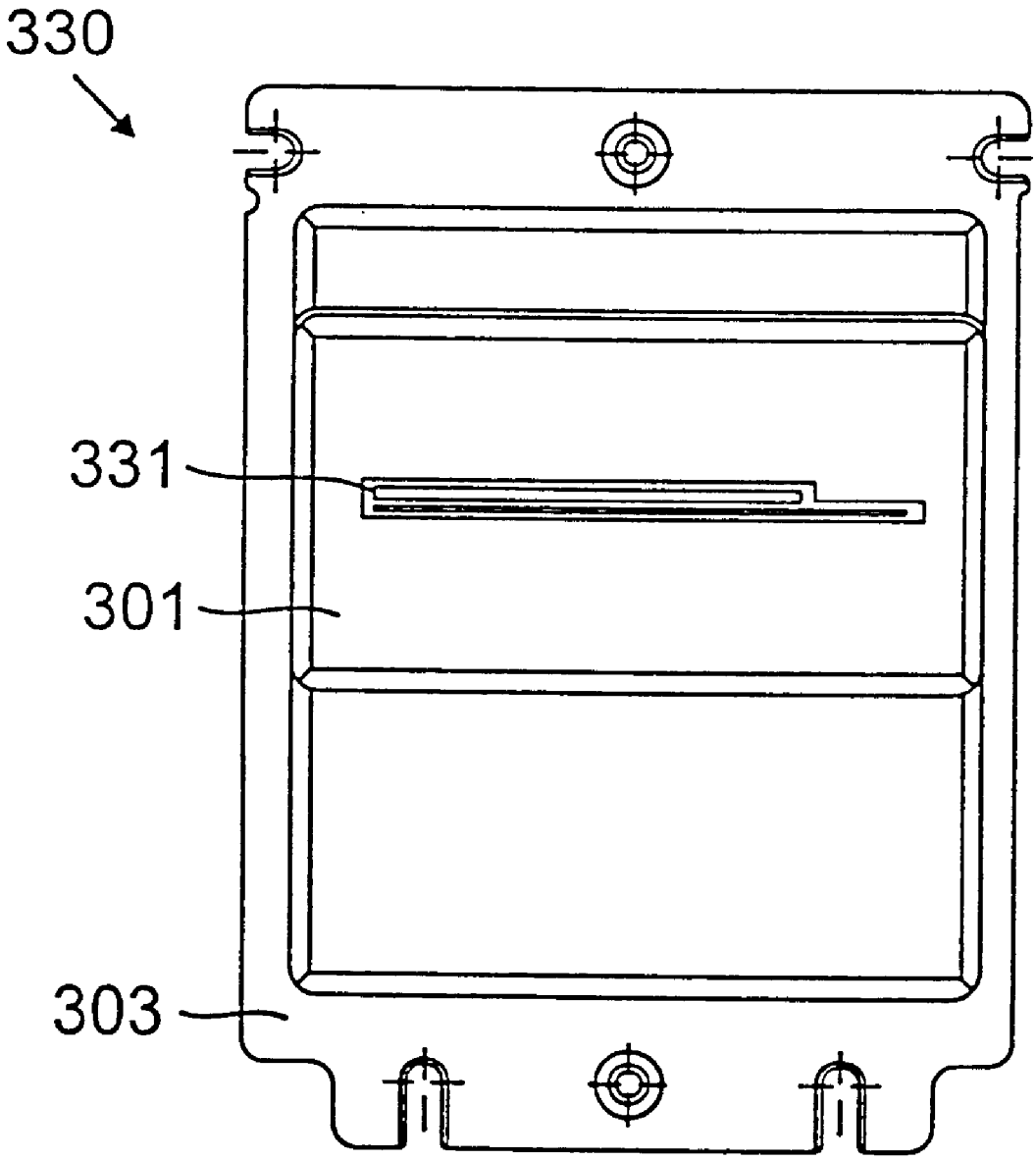

FIGS. 7B and 7C both illustrate a bezel 320 and 330 having one aperture 321, 331 for accepting two forms of payment. In particular, the bezel 320 of FIG. 7B has an opening 321 that has overlapping coin and bill entryways for accenting coins and bills, and the bezel 330 has an opening 331 that has overlapping card and bill entryways for accepting cards and bills. As shown, the vertical coin entryway opening in FIG. 7B is biased toward the right side of the face 301; however, other locations along the length of the bill entryway could be used. Similarly, the card entryway is shown above the bill entryway and biased to the left side of the face 301 in FIG. 7C, but it could be in other locations, such as below and in the center of the bill entrance. Further, the card entryway could be positioned in a vertical orientation, like the coin entryway of FIG. 7B, if there is adequate room in the face 301 and if such an orientation is preferable.

Figure 8A:
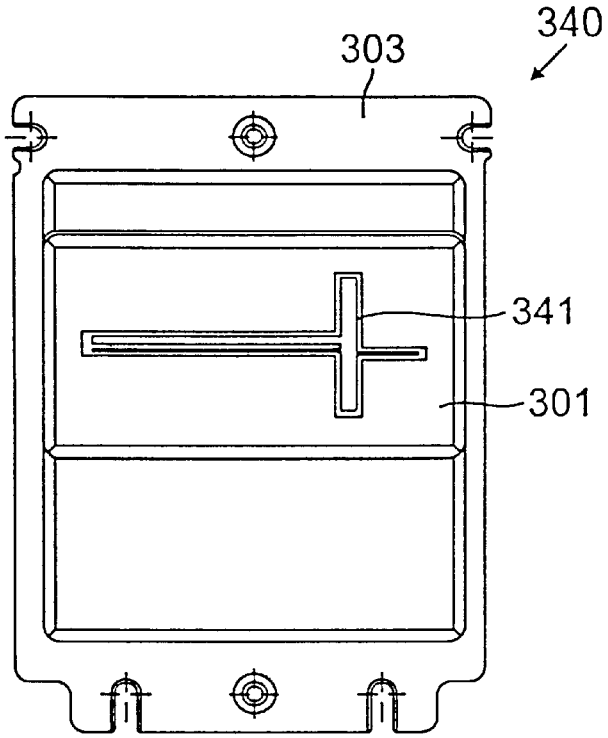
FIGS. 8A–8C are front views of three variations of another embodiment of a bezel according to the invention.
Figure 8B:
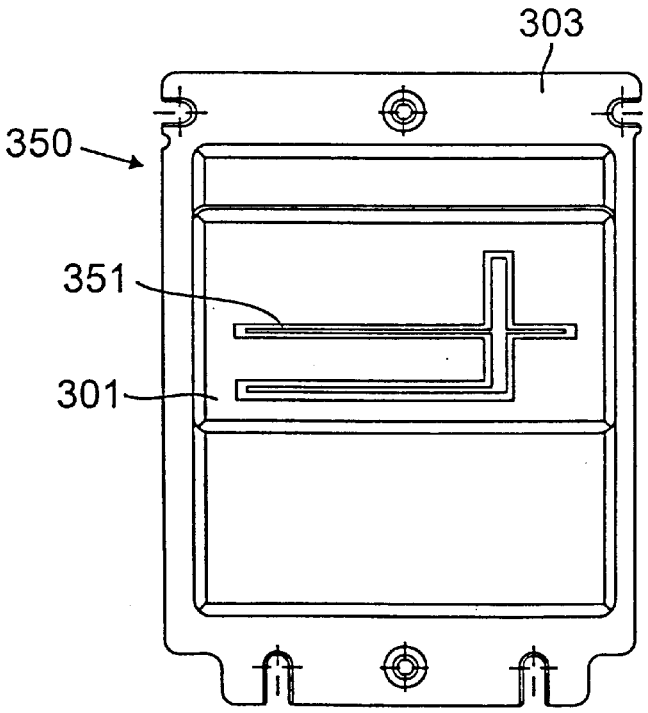
Figure 8C:
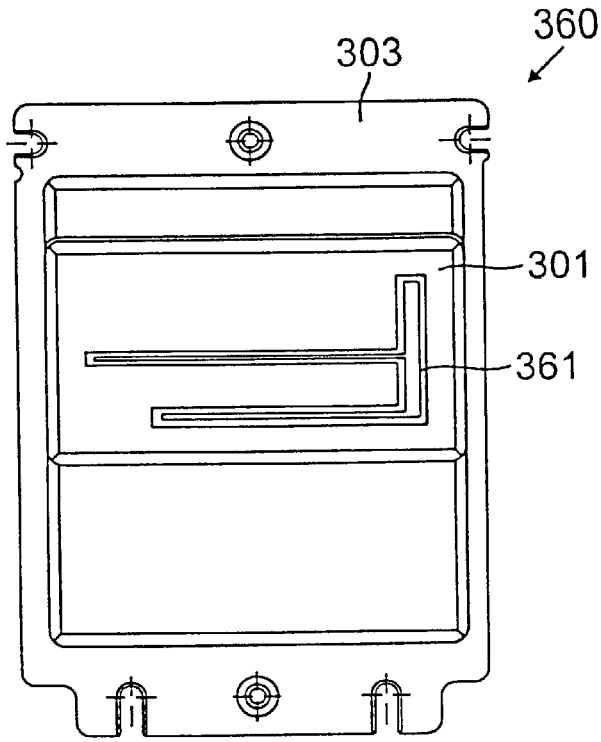

FIGS. 8A–8C illustrate alternate embodiments of a bezel having one aperture for accepting three forms of payment. In particular, each aperture 341, 351 and 361 in each of the bezels 340, 350 and 360 can accept coins or tokens, bills and cards. The embodiments of FIGS. 8A–8C depict different configurations of overlapping entryways for connection to internal payment acceptance means for coins or tokens, bills and cards.

Figure 9:
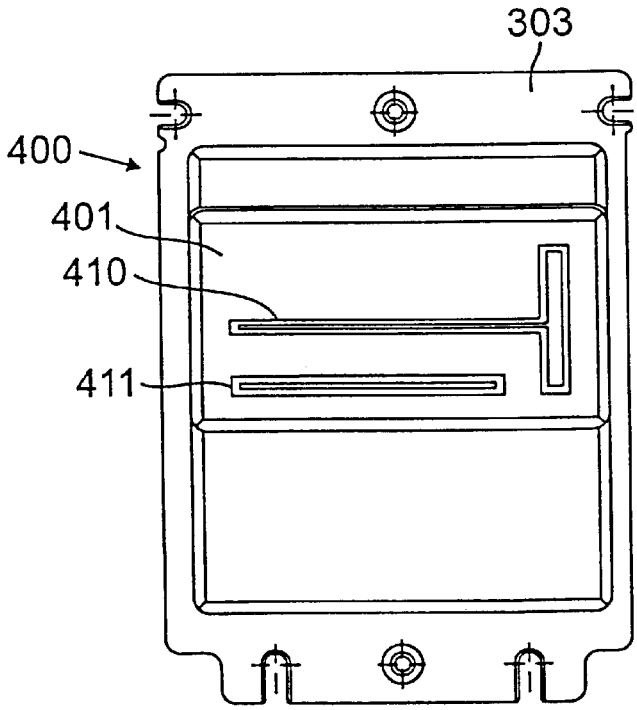
FIG. 9 is a front view of another embodiment of a bezel according to the invention.

FIG. 9 illustrates a bezel 400 having one aperture 410 for accepting coins or tokens and bills, and a second aperture 411 for accepting cards. Both apertures 410, 411 are located in the face 401 which fits through an opening in the panel of an automatic transaction machine. Other configurations of overlapping apertures for accepting other types of payment or for providing different combinations of payment types are readily apparent in view of the descriptions of FIGS. 7A–7C and 8A–8C above.

It should be understood from the foregoing that the invention enables a vending machine or other automatic transaction machine owner to provide one convenient location for accepting multiple forms of payment from a customer. Further, such a multiple payment area presents an attractive appearance. In addition, a bezel according to the invention gives a vending machine owner the freedom to easily utilize two or more forms of payment acceptance devices in one defined area without sacrificing front panel space which could be put to better use, for example, to advertise the products for sale. Yet further, a liquid diverting tray can be attached beneath the aperture or apertures of the bezel to provide protection from liquid attacks. In addition, one or more connectors may be integrated into the base plate of the bezel to simplify the electrical connections of the money acceptance means.

Although several embodiments of a bezel according to the invention have been shown in particular configurations, it should be understood that other combinations of money acceptance means in other configurations are contemplated. It is also to be understood that more than three openings could be utilized. Such alternate configurations may be necessary to accommodate various validation devices, to maximize consumer convenience, and/or to encourage one or more types of payment. Such a bezel may be manufactured after carefully considering the types of products to be sold in the automatic transaction machine. For example, if high-priced items are to be vended, then the bezel should contain a bill entryway and a card acceptance aperture or openings. Alternately, if low-priced items are to be vended, then one or more openings to accept coins and bills could be positioned in a way that encourages their use. One of skill in the art understands that the placement of the opening or openings in the bezel for accepting payment may be interchanged with one another, and also may be designed for accommodating other types of money acceptance means.

Further, although four connection openings 202 are shown on the base plate 203 to enable connection of the bezel 200 to a front panel of a vending machine, many other connection configurations could be used. Thus, although the present invention has been described in connection with several embodiments, many other variations and modifications will be apparent to those skilled in the art which will fall within the scope of the appended claims.

What is claimed is:

1. A bezel for a transaction area of an automatic transaction machine, comprising:

a face having dimensions to fit through an opening in a panel of the automatic transaction machine; and an aperture in the face for accepting at least three forms of payment in overlapping orientations, the aperture including at least three slots of different dimensions, each slot for accommodating a particular form of payment, wherein at least two forms of payment are accepted in a non-parallel orientation with respect to each other.

2. The bezel of claim 1, wherein the aperture is shaped for accepting coins, banknotes and cards.

3. The bezel of claim 1, wherein the aperture is shaped for accepting tokens, banknotes and cards.

4. The bezel of claim 1, further comprising an aperture for accommodating a coin reject button.

5. The bezel of claim 1, further comprising a liquid diverting tray connected beneath the aperture.

6. The bezel of claim 1, further comprising a base plate connected to the face for attachment to the front panel.

7. The bezel of claim 6, wherein the base plate further comprises at least one connector for accepting wires.

8. The bezel of claim 6, wherein the base plate further comprises a universal connector.

9. A consumer interface that defines a transaction area in the front panel of an automatic transaction device, comprising:

a face having an aperture for accepting at least three forms of payment in overlapping orientations, the aperture including at least three slots of different dimensions, each slot for accommodating a particular form of payment, wherein at least two forms of payment are accepted in a non-parallel orientation with respect to each other; and connection means behind the face for attaching the interface to the front panel.

10. The apparatus of claim 9, further comprising a fluid diverting tray connected beneath the aperture inside the automatic transaction device.

11. The apparatus of claim 9, further comprising a second aperture in the face of the interface for accommodating a transaction cancellation button.

12. The apparatus of claim 9, further comprising wire guide means connected to a base plate of the interface.

13. A bezel for attachment to the front panel of an automatic transaction machine, comprising:

a face having an aperture for accepting two forms of payment in overlapping, non-parallel orientations, wherein the aperture includes two slots of different dimensions, each slot approximately 90 degrees from each other for accommodating a particular form of payment; and connection means behind the face for attaching the bezel to the front panel.

14. The apparatus of claim 13, further comprising a second aperture for accepting a third form of payment.

* * * * *